United States Patent [19]

Lewis

[11] Patent Number: 5,027,781

[45] Date of Patent: Jul. 2, 1991

[54] EGR VALVE CARBON CONTROL SCREEN AND GASKET

[76] Inventor: Calvin C. Lewis, 849 McMahon Ave., Port Charlotte, Fla. 33948

[21] Appl. No.: 500,130

[22] Filed: Mar. 28, 1990

[51] Int. Cl.[5] ..... F02M 25/07

[52] U.S. Cl. ..... 123/568; 60/278

[58] Field of Search ..... 123/568, 569, 570, 571, 123/593; 60/276, 278

[56] References Cited

U.S. PATENT DOCUMENTS

| | | | |
|---|---|---|---|
| 3,294,073 | 12/1966 | Bressan | 123/568 |
| 3,834,366 | 9/1974 | Kingsbury | 123/568 |
| 4,205,644 | 6/1980 | Treadwell et al. | 123/568 |
| 4,237,840 | 12/1980 | Figueiras | 123/568 |
| 4,345,572 | 8/1982 | Suzuki et al. | 123/568 |
| 4,359,035 | 11/1982 | Johnson | 123/593 |
| 4,381,755 | 5/1983 | Caracciolo | 123/568 X |
| 4,384,563 | 5/1983 | Siefer et al. | 123/593 |
| 4,475,525 | 10/1984 | Fukae | 123/568 |
| 4,924,668 | 5/1990 | Panten et al. | 123/568 X |

*Primary Examiner*—Willis R. Wolfe

*Attorney, Agent, or Firm*—Frank A. Lukasik

[57] ABSTRACT

The invention relates to an improvement to exhaust gas recirculation (EGR) systems and in particular to a high temperature resistant wire screen affixed to the inlet opening of a carbon gasket for sealing the EGR valve to the manifold of an automobile engine and providing an effective barrier to keep large exhaust carbon flakes from entering the EGR system and clogging the valve.

7 Claims, 2 Drawing Sheets

EGR VALVE CARBON CONTROL SCREEN AND GASKET

BACKGROUND OF THE INVENTION

1. Field of the Invention

This invention relates to an improvement to Exhaust Gas Recirculation (EGR) Systems and in particular to a metal screen affixed to a carbon gasket for sealing the EGR valve to the manifold of an automobile engine and providing an effective barrier to keep large exhaust carbon flakes from entering the EGR system and clogging the valve.

2. Description of the Prior Art

There are several prior art attempts to combine a gasket with a screen to filter fluid streams. For example, Powers U.S. Pat. No. 3,124,930 discloses a catalyst screen attached to a gasket which is placed between the exhaust manifold and engine block. The gases leaving the cylinders will, while very hot, be in contact with the catalyst member. The high temperatures available at this point remove a substantial percentage of the unburned hydrocarbons. Powers does not consider the screen as a blocking member since all of the exhaust must pass through, however, accumulation of carbon particles will eventually totally block the screen and render it useless. The strainer gasket for sanitary piping systems disclosed in Hirsch U.S. Pat. No. 3,421,631 discloses an in-line filter screen which is formed within the gasket. The filter screen shown by Hirsch also suffers from the same defect as Powers and would eventually be clogged with impurities. Crook U.S. Pat. No. 3,206,216 discusses the difficulties associated with combining a screen with a gasket in the prior art and solves the problems with a one-piece gasket/filter. Large flakes would also block the fluid stream and would have to be disassembled periodically.

One prior art attempt by a major automobile manufacturer to solve the problem of valve clogging was to change the structure of the valve. In a notice to service facilities, it was noted that for the 5.0L engine EGR system, two major improvements were made over previous systems. The first was a stainless steel EGR valve. This valve is constructed of stainless steel to reduce the possibility of clogging. The second improvement is the replacement of the EGR solenoids with an electronic vacuum regulator. Although the changes did reduce some of the carbon buildup on the valve itself, it did not solve the problem of carbon building up within the manifold, breaking off in large flakes, and clogging the valve. None of the prior art devices have solved the problem of eliminating large carbon flakes from the fluid stream and preventing blocking of the screening material.

SUMMARY OF THE INVENTION

The Exhaust Gas Recirculation System (EGR) is designed to reintroduce exhaust gas into the combustion cycle which lowers combustion temperature and reduces the formation of Nitrous Oxides (NOx). Nitrous Oxides are a compound formed during the engine's combustion process when oxygen in the air combines with nitrogen in the air to form the nitrogen oxides which are agents in photochemical smog.

There are four basic types of EGR valves: The Integral Backpressure Valve; The Ported EGR Valve; The Electronic EGR Valve; and The Valve and Transducer Assembly EGR Valve. Typical components connected within the system are: EGR valve; Ported Vacuum Switch (PVS); and/or Thermal Vacuum Switch (TVS); and Carburetor EGR port or vacuum tank vacuum source. The amount of gas reintroduced and the timing of the cycle varies by calibration and is controlled by various factors such as engine speed, altitude, engine vacuum, exhaust system backpressure, coolant temperature and throttle angle depending on the calibration. All EGR valves are vacuum actuated.

The principal utility of the invention is to provide a long sought solution to the problem of large carbon particles (flakes) becoming lodged in the valve and holding it open. More specifically, the invention is a stainless steel screen affixed to a carbon gasket which is used to seal the EGR valve to the manifold.

Therefore there is a need for a simple, rugged, inexpensive fluid stream filter in exhaust gas recirculation systems.

It is therefore an object of the invention to provide an improved, reliable, exhaust gas recirculation system.

It is another object of the invention to provide a fluid stream filter in an EGR system.

Still another object of the invention is to provide an efficient fluid stream filter by combining a metal screen with a gasket.

It is also another object of the invention to provide an exhaust gas filter by combining a stainless steel screen with a carbon gasket to seal the EGR valve to the manifold to block carbon flakes from clogging the valve.

These and other objects of the invention will become apparent to those skilled in the art to which the invention pertains when taken in light of the annexed drawings.

DESCRIPTION OF THE PREFERRED EMBODIMENT

Figure 1:
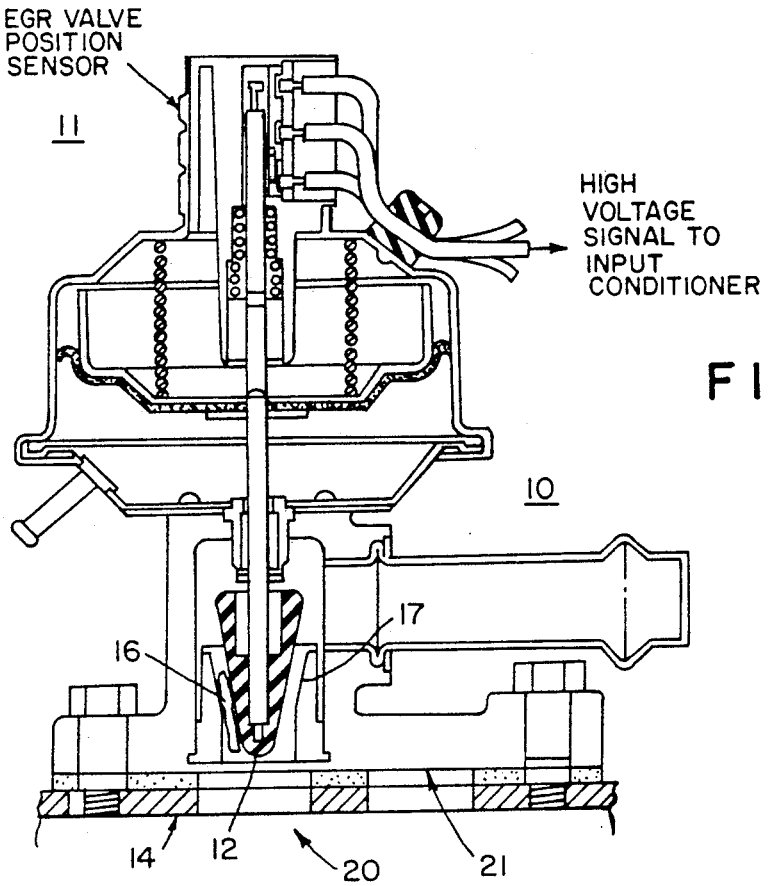
FIG. 1 shows schematically, in cross section, typical prior art EGR assembly.
Figure 2:
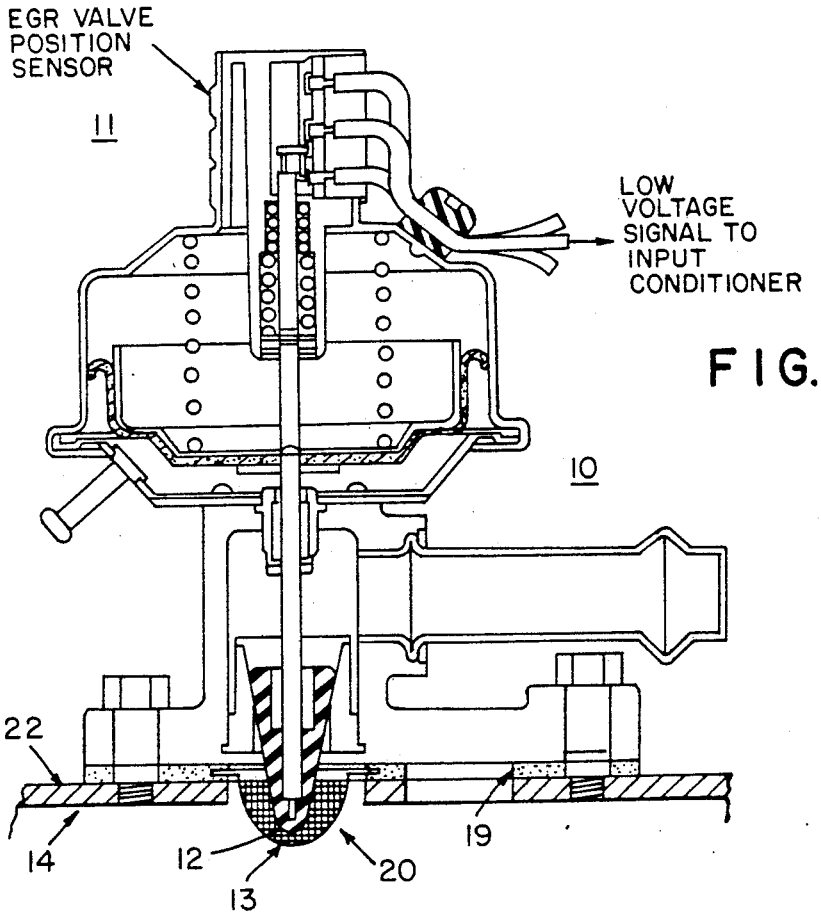
FIG. 2 shows schematically, in cross section, a typical EGR assembly with a valve carbon control screen and gasket of the invention.

Referring now in more detail to the drawings, FIGS. 1 and 2 show a typical Exhaust Gas Recirculation (EGR) system 10. FIG. 1 shows the current and prior art EGR system including an EGR Valve Position Sensor 11, an EGR valve 12, a carbon control screen and gasket 13, and an exhaust manifold 14.

The Exhaust Gas Recirculation (EGR) system is a process where a small amount of exhaust gas is readmitted to the combustion chamber to reduce peak combustion temperatures and thus reduce NOx emissions. An electronic EGR valve 12 is required in Engine Emission Control (EEC) systems where EGR flow is controlled according to computer demands by means of an EGR valve position sensor 15 attached to the valve 12. The valve is operated by a vacuum signal from the dual EGR solenoid valves or the electronic vacuum regulator which actuates the valve diaphram.

When a car is at idle speed, or slow speed, valve pintle 12 is in a lower position (closed) as shown in FIG. 2. As the car accelerates and reaches a cruising speed, the valve 12 is opened by the exhaust pressure passing thru the manifold 14. As long as the valve 12 remains open, the EGR valve position sensor 11 produces a signal to the computer and the engine continues in normal operation. Under normal conditions, as the car decelerates, the valve closes and the return exhaust gas is cut off by valve 12. The EGR valve position sensor 11 (down position) then signals the computer of the status of the engine speed and all systems return to normal. The entire process is begun when the engine is restarted or accelerated and the valve 12 reopens to signal the computer of the status of the engine.

As shown in FIG. 1, if at any time during the operation of the engine, a particle or flake of carbon 16 is released in the exhaust system and enters the EGR valve 12 and becomes jammed between the valve 12 and its seat 17, the valve position sensor 11 will indicate an erroneous status of the valve 12. Failure of the valve position sensor 11 to indicate the proper status of the EGR system 10 will result in: stalling; rough idle; engine surges; poor performance; or poor fuel economy. As long as the engine continues at high speed, the engine performance will not be adversely effected if the valve 12 is in the open (normal) position. At highway speed the valve 12 should be opened. As the car decelerates and comes to a stop, the sensor 11 continues to provide an erroneous high speed signal to the computer and the engine will either stall if running or will not restart if stopped. If a car starts across an intersection and the driver lets off the gas pedal, the engine will stall if the valve 12 is open, the car will suddenly slow down without the stoplights being lit, and a rear end collision may result.

Normally, the car cannot be restarted until the EGR valve is removed and the valve 12 is either unclogged or the EGR valve is replaced. Since the EGR system 10 is part of the emission system, the costs of towing, replacement, and overnight loaner cars are generally borne by the manufacturer. These costs can exceed $200.00 per incident.

Figure 3:
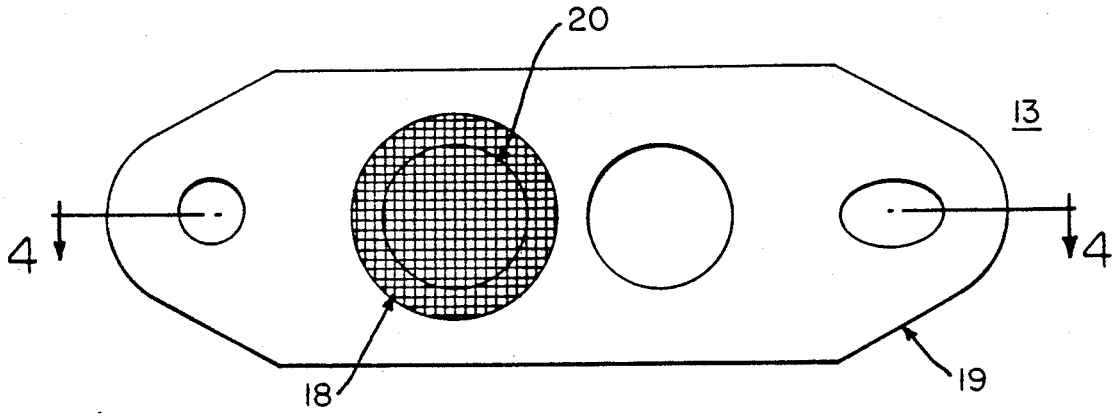
FIG. 3 is a top view of the valve carbon control screen and gasket of the invention.
Figure 4:
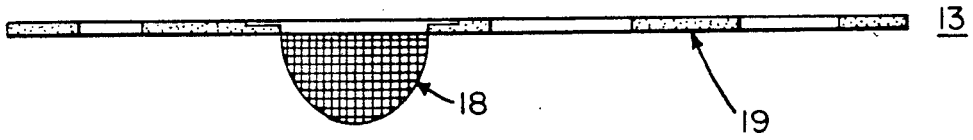
FIG. 4 is a side view of the valve carbon control screen and gasket of the invention.
Figure 5:
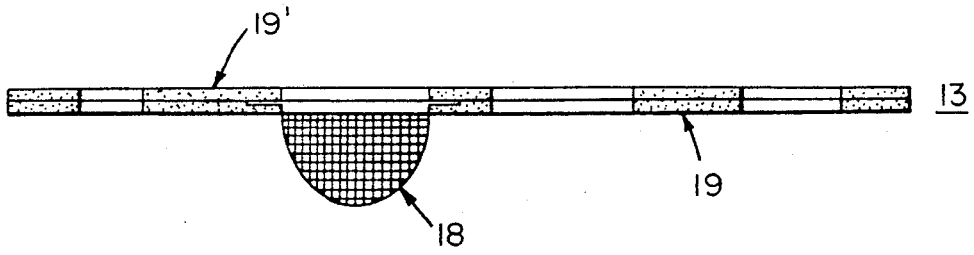
FIG. 5 is a side view of a second embodiment of the invention.

Mounting a filter (screen) 18 on the carbon gasket 19 provides a simple, rugged, barrier which prevents carbon 16 flakes from entering the EGR valve system. As shown in FIGS. 3–5, a cup-shaped filter 18 is inserted in the exhaust gas inlet opening 20 and fastened in an appropriate manner, as for example, pressed into gasket 19 and cemented with a high temperature cement to gasket 19. The filter 18 is preferably made from stainless steel wire screen but may also be made from other high temperature resistant filter material such as ceramic. As noted in the above discussion, stainless steel was the choice of one major car manufacturer to solve the problem of carbon in the EGR system. Although the filter 18 is shown as cup-shaped, in some applications, i.e., where the valve 12 does not protrude into the manifold 14, the filter may be flat as it does not need the clearance provided by the cup-shape. The mesh size of the filter 18 is not critical to the performance of the invention since small particles of carbon, e.g., 1/16" may pass thru the EGR system 10 without affecting its operation.

Although the preferred embodiment of the invention uses a carbon gasket 19, a standard manufacturer's part, it could be made of other high temperature resistant gasket materials. The diameter of the rim of screen 18 is dependent on the diameter of the gas inlet 20. The flat rim of filter 18 should be sufficiently large to ensure a gripping fit between the EGR system 10 and the exhaust manifold 14.

FIG. 5 shows a second embodiment of the invention wherein the filter 18 is secured by a second gasket 19' which is placed over the screen 18 to hold the screen 18 firmly in place between the gaskets 19 and 19'. Since the dimensions of the various size EGR systems available on the market may vary, several different sizes of filters 18 will be required to mate with the different sized gaskets. During the flow of exhaust gases from the manifold 14 to gas inlet 20, for example, the filter element screen 18 will deflect any large carbon flakes 16 which will continue flowing thru the exhaust system rather than entering the EGR system 10, while the gasket 19 when initially installed as shown in FIG. 1, prevents leakage of exhaust outwardly between EGR face 21 and manifold face 22. The carbon control screen and gasket 13 of the invention provides an efficient means for modifying existing and new cars during assembly to prevent valve clogging without reworking the EGR system 10.

Although the EGR system 10 shown in FIGS. 1 and 2 is a Ford part, other U.S. auto manufacturer's systems operate on the same principle and suffer from the same valve blockage by carbon flakes and may be improved with this invention. Japanese and foreign manufacturers may also benefit from this invention.

While the invention has been explained with respect to a preferred embodiment thereof, it is contemplated that various changes may be made in the invention without departing from the spirit and scope thereof.

What is claimed is:

1. In an exhaust gas recirculation system adapted to extract exhaust gas from an automobile engine manifold and reintroduce said exhaust gas into the combustion cycle of an automobile engine to lower combustion temperature and thus reduce formation of nitrous oxides, the improvement comprising:

a high temperature resistant gasket having an inlet opening and adapted to provide a seal between said exhaust gas recirculation system and said manifold of said automobile engine; and a high temperature resistant filter affixed to said gasket within said inlet opening and adapted to provide a barrier to large carbon particles contained in said exhaust gas.

2. A gasket as defined in claim 1 wherein said gasket inlet opening is formed with a circumferential indentation to provide a seat for said filter.

3. A gasket as defined in claim 2 wherein, said filter is seated in said indentation and fixed to said gasket with a high temperature resistant adhesive.

4. A filter as defined in claim 1 comprising a cup-shaped stainless steel wire screen.

5. A gasket as claimed in claim 1 wherein said high temperature resistant gasket comprises carbon.

6. A gasket as claimed in claim 5 wherein said gasket comprises two carbon seals each having inner and outer sealing surfaces and a stainless steel wire screen clamped between said inner sealing surfaces.

7. In an exhaust gas recirculation system adapted to extract exhaust gas from an automobile engine manifold and reintroduce said exhaust gas into the combustion cycle of an automobile engine to lower combustion temperature and thus reduce formation of nitrous oxides, the improvement comprising:

a carbon gasket having an inlet opening formed with a circumferential indentation on a first surface and adapted to provide a seal between said exhaust gas recirculation system and said manifold of said automobile engine; and a stainless steel wire screen seated in said indentation and within said inlet opening and fixed to said gasket with a high temperature resistant adhesive.

* * * * *